US006695965B1

(12) United States Patent
Wittenbrink et al.

(10) Patent No.: US 6,695,965 B1
(45) Date of Patent: Feb. 24, 2004

(54) PROCESS FOR ADJUSTING THE HARDNESS OF FISCHER-TROPSCH WAX BY BLENDING

(75) Inventors: Robert J. Wittenbrink, Kingwood, TX (US); Daniel Francis Ryan, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/542,895

(22) Filed: Apr. 4, 2000

(51) Int. Cl.[7] ..... C10G 73/38

(52) U.S. Cl. ..... 208/27; 208/24; 208/20; 208/21; 585/1; 585/9; 585/733; 585/734; 585/700; 585/728

(58) Field of Search ..... 208/24, 27, 20, 208/21; 585/1, 9, 733, 734, 700, 728

(56) References Cited

U.S. PATENT DOCUMENTS

| | | | | |
|---|---|---|---|---|
| 4,568,663 A | | 2/1986 | Mauldin | 502/325 |
| 4,943,672 A | | 7/1990 | Hamner et al. | 585/737 |
| 5,032,249 A | | 7/1991 | Jones et al. | 208/24 |
| 5,260,239 A | | 11/1993 | Hsia | 502/30 |
| 5,348,982 A | | 9/1994 | Herbolzheimer et al. | 518/700 |
| 5,750,819 A | | 5/1998 | Wittenbrink et al. | 585/734 |
| 5,814,109 A | * | 9/1998 | Cook et al. | 44/300 |
| 5,904,834 A | | 5/1999 | Ansorge et al. | 208/24 |
| 6,296,757 B1 | * | 10/2001 | Wittenbrink et al. | 208/15 |
| 6,309,432 B1 | * | 10/2001 | Wittenbrink et al. | 44/436 |

FOREIGN PATENT DOCUMENTS

| | | | |
|---|---|---|---|
| EP | 0145042 | 6/1985 | C10G/45/60 |
| EP | 0266898 B1 | 5/1988 | B01J/35/02 |
| EP | 0435619 | 7/1991 | C10G/45/62 |
| EP | 0579330 | 1/1994 | C10G/2/00 |

OTHER PUBLICATIONS

Ryland, Lloyd B., Tamele, M.W. and Wilson, J.N., Cracking Catalysts, Catalysis, vol. VII, Ed. Paul H. Emmet, Reinhold Publishing Corporation, New York, 1960, pp. 5–9.

* cited by examiner

*Primary Examiner*—Thuan D. Dang
(74) *Attorney, Agent, or Firm*—Mark D. Marin

(57) ABSTRACT

A wax blending process is disclosed which retains the desirable properties of a Fischer-Tropsch wax, while adjusting the hardness of the wax to within to a desired range. The invention utilizes a synergistic effect between hard virgin Fischer-Tropsch wax and softer mildly isomerized Fischer-Tropsch wax in a blending process which allows the artisan to adjust the hardness of a wax product to within desired ranges. The process involves passing a Fischer-Tropsch wax over a hydroisomerization catalyst under predetermined conditions including relatively mild temperatures such that chemical conversions (e.g., hydrogenation and mild isomerization) take place while less than 10% boiling point conversion (hydrocracking) occurs, thus preserving overall isomerized wax yield. At least a portion of the resulting isomerized wax is then blended with untreated hard virgin

5 Claims, 1 Drawing Sheet

PROCESS FOR ADJUSTING THE HARDNESS OF FISCHER-TROPSCH WAX BY BLENDING

FIELD OF THE INVENTION

This invention relates to the production of waxes useful in a number of applications requiring waxes that meet exacting standards such as coating materials, adhesives, candles, cosmetics, food and drug applications. More particularly, this invention relates to the production of waxes produced by the reaction of carbon monoxide and hydrogen, the Fischer-Tropsch hydrocarbon synthesis process. Still more particularly, this invention relates to a process whereby at least a portion of raw Fischer-Tropsch wax is subjected to a mild isomerization and blended into untreated Fischer-Tropsch wax to achieve desirable properties.

BACKGROUND OF THE INVENTION

The catalytic production of higher hydrocarbon materials from synthesis gas, i.e. carbon monoxide and hydrogen, commonly known as the Fischer-Tropsch process, has been known for many years. Such processes rely on specialized catalysts.

The original catalysts for Fischer-Tropsch synthesis were typically Group VIII metals, particularly cobalt and iron, which have been adapted for the process throughout the years to produce higher hydrocarbons. As the technology developed, these catalysts became more refined and were augmented by other metals that function to promote their activity as catalysts. Such promoter metals include the Group VIII metals, such as platinum, palladium, ruthenium, and iridium, other transition metals such as rhenium and hafnium as well as alkali metals. The choice of a particular metal or alloy for fabricating a catalyst to be utilized in Fischer-Tropsch synthesis will depend in large measure on the desired product or products.

The products from hydrocarbon synthesis are useful in a variety of applications. The waxy product of hydrocarbon synthesis, particularly the product from a cobalt based catalyst process contains a high proportion of normal paraffins. It is generally known to catalytically convert the paraffin wax obtained from the Fischer-Tropsch process to lower boiling paraffinic hydrocarbons falling within the gasoline and middle distillate boiling ranges, primarily by hydrogen treatments, e.g. hydrotreating, hydroisomerization and hydrocracking. However, new markets continue to expand in demand for petroleum and synthetic waxes. The varied and growing uses for the waxes, e.g. food containers, waxed paper, coating materials, electrical insulators, candles, crayons, markers, cosmetics, etc. have lifted this material from the by-product class to the product class in many applications.

Stringent requirements are set by regulatory authorities such as the FDA in the United States and the SCF in the European Union, which a wax should meet, particularly if the wax is to be used in food and drug applications. Further, it is a demanding task for the crude oil refiner to meet those requirements. Petroleum waxes derived from crude oil often have dark color, poor odor and numerous impurities requiring significant further refining, particularly when wax is to be used in food and drug applications which require highly refined wax in order to satisfy regulatory authorities. The presence of sulfur, nitrogen and aromatic species, which induce a yellowish or brownish color, are undesirable and may present considerable health risks. Intensive wax refining techniques are required to improve thermal and light properties, ultra-violet stability, color, storage stability and oxidation resistance of the end products. Typically, such waxes are subjected to wax decolorization processes commonly denoted as wax finishing. Such methods are part of a time consuming and costly process and have a detrimental effect on opacity which is desirable in a number of applications where superior thermal and light properties, ultra-violet stability, color and storage stability are desired. These applications include, but are not limited to coating materials, crayons, markers, cosmetics, candles, electrical insulators and the like as well as food and drug applications.

Waxes prepared by the hydrogenation of carbon monoxide via the Fischer-Tropsch process have many desirable properties. They have high paraffin contents, an opaque white color, and are essentially free of any sulfur, nitrogen and aromatic impurities found in petroleum waxes. However, untreated Fischer-Tropsch waxes may contain a small quantity of olefins and oxygenates (e.g. long chain primary alcohols, acids and esters) which can cause corrosion in certain environments. In addition Fischer-Tropsch waxes are harder than conventional petroleum waxes. The hardness of waxes and wax blends as measured by needle penetration can vary considerably. Wax hardness is generally measured by the needle penetration test ASTM D 1321. In general, the hardness of Fischer Tropsch waxes is an advantage since there exists a shortage of high-grade hard paraffin waxes. However, such hardness could limit the usefulness of untreated Fischer-Tropsch waxes in certain applications. Fischer-Tropsch waxes typically undergo severe hydroprocessing to obtain high purity. Virgin Fischer-Tropsch waxes subjected to these prior art processes tend to lose their opaque white property and may become so soft in the process as to render them commercially undesirable requiring costly additives to effect opacity and adjust hardness. It is therefore desirable to provide a hydroprocessing method by which the hardness of these waxes could be adjusted to within selected ranges while maintaining the desirable opaque white property of the untreated raw Fischer-Tropsch wax, thus reducing or eliminating the need for costly additives and further treatment.

SUMMARY OF THE INVENTION

In one embodiment, the invention is directed toward a blending process, which retains the desirable properties of a Fischer-Tropsch wax, e.g. the opacity, while adjusting the hardness of the wax to within to a desired range. In another embodiment the invention utilizes a synergistic effect between hard virgin Fischer-Tropsch wax and softer mildly isomerized Fischer-Tropsch wax in a blending process which allows the artisan to adjust the hardness of a wax product to a desired range. The process involves passing a Fischer-Tropsch wax over a hydroisomerization catalyst under predetermined conditions including relatively mild temperatures such that chemical conversions (e.g., hydrogenation and mild isomerization) take place while less than 10% boiling point conversion (hydrocracking) occurs, thus preserving overall isomerized wax yield. At least a portion of the resulting isomerized wax is then blended with untreated hard virgin Fischer-Tropsch wax to adjust the harness thereof.

In another embodiment of the present invention, synthesis gas (hydrogen and carbon monoxide in an appropriate ratio) is fed into a Fischer-Tropsch reactor, preferably a slurry reactor, and contacted therein with an appropriate Fischer-Tropsch catalyst. A hard virgin Fischer-Tropsch wax product is recovered from the reactor. At least a portion of this hard virgin Fischer-Tropsch wax is then introduced into a hydroisomerization process unit along with hydrogen and contacted therein with a hydroisomerization catalyst under mild hydroisomerization conditions. The resulting softer isomerized wax is then blended with untreated hard, virgin Fischer-Tropsch wax in such an amount that a desired hardness of the blended wax is achieved. In a more preferred embodiment, the softer isomerized wax is blended with untreated hard virgin Fischer-Tropsch wax in such an amount that a desired hardness of the blended wax is achieved while maintaining an opaque white color comparable to that of the untreated hard virgin Fischer-Tropsch wax.

DETAILED DESCRIPTION OF THE INVENTION

Figure 1:
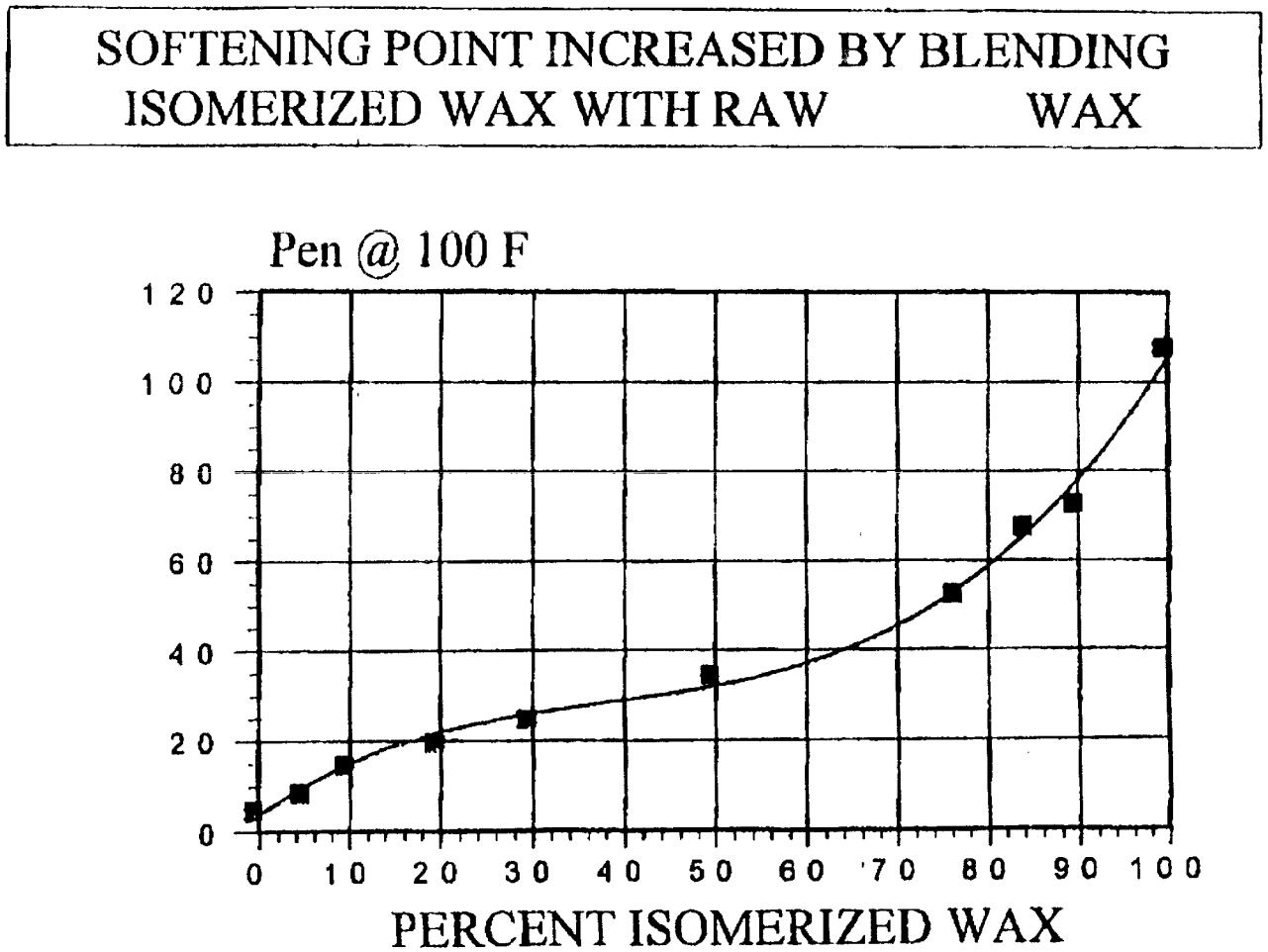
FIG. 1 shows a graph depicting exemplary data from the present invention hydroisomerization process.

The Fischer-Tropsch process can produce a wide variety of materials depending on catalyst and process conditions. The waxy product of a hydrocarbon synthesis process, particularly the product from a cobalt based catalyst process, contains a high proportion of normal paraffins. Cobalt is a preferred Fischer-Tropsch catalytic metal in that it is desirable for the purposes of the present invention to start with a Fischer-Tropsch wax product with a high proportion of linear $C_{20+}$ paraffins.

A preferred Fischer-Tropsch reactor to produce the raw wax of the present invention is the slurry bubble column reactor. This reactor is ideally suited for carrying out highly exothermic, three phase catalytic reactions. In such reactors (which may also include catalyst rejuvenation/recycling means as shown in U.S. Pat. No. 5,260,239) the solid phase catalyst is dispersed or held in suspension in a liquid phase at least partly by a gas phase which continuously bubbles through the liquid phase. The catalysts utilized in such reactors can be either bulk catalysts or supported catalysts.

The catalyst in a slurry phase Fischer-Tropsch reaction useful in the present inventions is preferably a cobalt, more preferably a cobalt-rhenium catalyst. The reaction is run at pressures and temperatures typical in the Fischer-Tropsch process, i.e., temperatures ranging from about 190° C. to about 235° C., preferably from about 195° C. to about 225° C. The feed may be introduced at a linear velocity of at least about 12 cm/sec, preferably from about 12 cm/sec to about 23 cm/sec. A preferred process for operating a slurry phase Fischer-Tropsch reactor is described in U.S. Pat. No. 5,348,982.

A preferred Fischer-Tropsch Process is one that utilizes a non-shifting, (that is, no water gas shift capability) catalyst. Non-shifting Fischer-Tropsch reactions are well known to those skilled in the art and may be characterized by conditions that minimize the formation of $CO_2$ by products. Non shifting catalysts include. e.g. cobalt or ruthenium or mixtures thereof, preferably cobalt, and more preferably a supported, promoted cobalt, the promoter being zirconium or rhenium, preferably rhenium. Such catalysts are well known and a preferred catalyst is described in U.S. Pat. No. 4,568,663 as well as European Patent 0 266 898.

By virtue of the Fischer-Tropsch process, the recovered $C_{20}$+ waxy hydrocarbons in the 371° C.+ boiling range have nil sulfur and nitrogen. These hetero-atom compounds are poisons for the Fischer-Tropsch catalysts and are removed from the methane-containing natural gas that is conveniently used for preparing the synthesis gas feed for the Fischer-Tropsch process. Small amounts of olefins are produced in the Fischer-Tropsch Process, as well as some oxygenated compounds including alcohols and acids.

The raw wax product of a Fischer-Tropsch synthesis is subjected to a hydroisomerization process. The entire liquid effluent of the synthesis process may be withdrawn from the reactor and led directly to the hydroisomerization stage. In another embodiment, the unconverted hydrogen, carbon monoxide and water formed during the synthesis may be removed prior to the hydroisomerization step. If desired, the low molecular weight products of the synthesis stage, in particular, the $C_4$− fraction, for example, methane, ethane and propane may also be removed prior to the hydroisomerization treatment. The separation is conveniently effected using distillation techniques well known in the art. In another embodiment, a wax fraction typically boiling above 371° C. at atmospheric pressure is separated from the hydrocarbon product of the Fischer-Tropsch process and subjected to the hydroisomerization process. In yet another and preferred embodiment, a wax fraction boiling above 413° C. at atmospheric pressure is separated from the hydrocarbon product of the Fischer-Tropsch process and subjected to the hydroisomerization process.

Hydroisomerization is a well-known process and its conditions can vary widely. One factor to be kept in mind in hydroisomerization processes is that increasing conversion of feed hydrocarbons boiling above 371° C. to hydrocarbons boiling below 371° C. tends to increase cracking with resultant higher yields of gases and other distillates and lower yields of isomerized wax. In the present invention, cracking is maintained at a minimum, usually less than 10%, preferably less than 5%, more preferably less than 1% thus maximizing wax yield.

The hydroisomerization step is carried out over a hydroisomerization catalyst in the presence of hydrogen under conditions such that the 371° C.+ boiling point conversion to 371° C.− is less than about 10%, more preferably less than about 5%, most preferably less than about 1%. These conditions comprise relatively mild conditions including a temperature from about 204° C. to about 343° C., preferably from about 286° C. to about 321° C. and a hydrogen pressure of about 300 to about 1500 psig, preferably about 500 to about 1000 psig, more preferably about 700 to about 900 psig to reduce oxygenate and trace olefin levels in the Fischer-Tropsch wax and to partially isomerize the wax.

Typical broad and preferred conditions for the hydroisomerization step of the present invention are summarized in the table below:

| Condition | Broad Range | Narrow Range |
|---|---|---|
| Temperature, ° C. | 204–343 | 286–321 |
| Total Pressure, psig | 300–1500 | 500–1000 |
| Hydrogen Treat Rate, SCF/B | 500–5000 | 2000–4000 |

While virtually any catalyst useful in hydroisomerization may be satisfactory for the mild hydrotreating/hydroisomerization step, some catalysts perform better than others and are preferred. For example, catalysts containing a supported Group VIII noble metal, e.g., platinum or palladium, are useful as are catalysts containing one or more Group VIII base metals, e.g., nickel or cobalt, in amounts of about 0.5–20 wt % which may or may not also include a Group VI metal, e.g. molybdenum in amounts of about 1–20 wt %. The support for the metals can be any refractory oxide or zeolite or mixtures thereof. Preferred supports include silica, alumina, silica-alumina, silica-alumina phosphates, titania, zirconia, vanadia, and other Group III, IV, VA or VI oxides, as well as Y sieves, such as ultrastable Y sieves. Preferred supports include alumina and silica-alumina where silica concentration of the bulk support is less than about 50 wt %, preferably less than about 35 wt %. More preferred supports include amorphous silica-alumina co-gel where the silica is present in amounts of less than about 20 wt %, preferably 10–20 wt %. Also the support may contain small amounts, e.g., 20–30 wt %, of a binder, e.g., alumina, silica, Group IV A metal oxides, and various types of clays, magnesia, etc., preferably alumina.

Preferred catalysts of the present invention include those comprising a non-noble Group VIII metal, for example, cobalt, in conjunction with a Group VI metal, for example, molybdenum, supported on an acidic support. A preferred catalyst has a surface area in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

A preferred catalyst is prepared by co-impregnating the metals from solutions onto the supports, drying at 100–150° C., and calcining in air at 200–550° C. The preparation of amorphous silica-alumina microspheres for supports is described in Ryland, Lloyd B., Tamele, M. W., and Wilson, J. N. Cracking Catalysts, Catalysis: volume VII, Ed. Paul H. Emmett, Reinhold Publishing Corporation, New York, 1960, pp. 5–9.

In a preferred catalyst, the Group VIII metal is present in amounts of about 5 wt % or less, preferably 2–3 wt %, while the Group VI metal is usually present in greater amounts, e.g., 10–20 wt %. A typical catalyst is shown below:

| | |
|---|---|
| Co wt % | 2.5–3.5 |
| Mo wt % | 15–20 |
| $Al_2O_3$—$SiO_2$ | 60–70 |
| $Al_2O_{3\text{-binder}}$ | 20–25 |
| Surface Area | 290–355 $m^2$/gm |
| Pore Volume (Hg) | 0.35–0.45 ml/gm |
| Bulk Density | 0.58–0.68 g/ml |

The present invention utilizes a synergistic effect between hard, virgin Fischer-Tropsch wax and softer mildly isomerized Fischer-Tropsch wax in a blending process. The concept of blending untreated virgin Fischer-Tropsch wax (i.e., harder wax) with isomerized Fischer-Tropsch wax (i.e., soft wax) in order to meet desired specifications is quite novel. Consequently, small amounts of the softer, treated isomerized wax have a greater than expected effect on the hardness of the blend. Significant savings can be realized by treating only a portion of wax produced via Fischer Tropsch synthesis to reduce the hardness (increase the needle penetration value) and then blending this material with untreated, harder Fischer-Tropsch wax to obtain an end product with a desirable needle penetration value as well as a desired degree of opacity.

EXAMPLE 1

Preparation of Fischer-Tropsch Wax

A mixture of hydrogen and carbon monoxide synthesis gas ($H_2$/CO=2.0–2.2) was converted to heavy paraffins in a slurry bubble column Fischer-Tropsch reactor. The catalyst utilized was a titania supported cobalt rhenium catalyst previously described in U.S. Pat. No. 4,568,663. The reaction was conducted at about 204–232° C., 280 psig, and the feed was introduced at a linear velocity of 12 to 17.5 cm/sec. The Fischer-Tropsch wax product was withdrawn directly from the slurry reactor.

The boiling point distribution of this wax is shown in Table 1.

TABLE 1

Boiling Point Distribution of Virgin Fischer-Tropsch Wax

| Fraction | Reactor Wax |
|---|---|
| IBP–177° C. | 0.00 |
| 177–260° C. | 0.70 |
| 260–371° C. | 20.48 |
| 371° F.+ | 78.82 |

EXAMPLE 2

Fractionation of Fischer-Tropsch Virgin Wax

A portion of the Fischer-Tropsch wax prepared in Example 1 was fractionated under vacuum to produce a fraction boiling greater than about 441° C.

EXAMPLE 3

Hydroprocessing Fischer-Tropsch Virgin Wax

Another portion of The Fischer-Tropsch wax prepared in Example 1 was treated over the cobalt/molybdenum on silica-alumina catalyst described herein at the following conditions: LHSV=1.41, temperature=348° C., reactor pressure (outlet)=725 psig and a hydrogen treat gas rate of 1955 SCF/Bb1. The total liquid product from this run was then fractionated under vacuum to produce a fraction boiling greater than about 413° C. Conditions and yields are summarized as follows in Table 2.

TABLE 2

| | Raw (Untreated) Wax | Isomerized wax (treated) Wax |
|---|---|---|
| LHSV | | 1.397 |
| Temperature, ° C. | | 348.2 |
| P (outlet), Psig | | 725.0 |
| $H_2$ Treat, SCF/B | | 2140 |
| Yield, wt. % | | |
| $C_1$ | | 0.004 |
| $C_2$ | | 0.012 |
| $C_3$ | | 0.072 |
| i-$C_4$ | | 0.135 |
| n-$C_4$ | | 0.099 |
| $C_5$-413° C. | — | 55.310 |
| $C_5$-441° C. | 56.69 | — |
| 413° C.+ | | 44.368 |
| 441° C.+ | 43.31 | — |
| | 100.00 | 100.000 |

Thus two samples were prepared: a 441° C.+ fraction of raw Fischer Tropsch wax and 413° C.+ fraction of hydroisomerized wax obtained by fractionating the total liquid product from the hydroisomerization run and recovering a 413° C.+ heavy bottom product.

Whereas the untreated virgin wax produced in Example 2 was opaque (bright white) and very hard (needle penetration of 5 dmm at 37.8° C.), the isomerized wax produced in Example 3 was translucent and very soft (needle penetration of 108 dmm at 37.8° C.)

EXAMPLE 4

Blending

Since the virgin Fischer-Tropsch wax produced in example 2 was harder than many of the typically marketed waxes which have a needle penetration value of, e.g., 7–15 and the isomerized wax of Example 3 was softer than these typically marketed waxes, a series of blends were formulated to prepare waxes with needle penetrations more typical of waxes commercially marketed. The series of blends was prepared by mixing the 441° C.+ raw wax with the 413° C.+ treated wax. Wax penetration data (ASTM D-1321@37.8° C.) were obtained on each material and blends thereof. The particular wax fractions chosen for the blending study described herein do not necessarily correspond to a particular grade of wax marketed commercially, and boiling ranges were selected solely to demonstrate proof of a principle as defined below.

Table 3 below shows the needle penetration (ASTM D 1321) of wax blends prepared with the two waxes described in Examples 2 and 3. Penetration is measured with a penetrometer, which applies a standard needle to the sample for 5 seconds under a load of 100 grams.

TABLE 3

Properties of Blended Fischer-Tropsch Waxes

| Sample # | Wt % Virgin Fischer Tropsch Wax (B.P. 441° C.+) | Wt % Isomerized Fischer-Tropsch Wax (B.P. 413° C.+) | Needle Penetration, ddm at 37.8° C. |
|---|---|---|---|
| 1 | 100.0 | 0.0 | 5 |
| 2 | 95.0 | 5.0 | 9 |
| 3 | 90.0 | 10.0 | 15 |
| 4 | 80.0 | 20.0 | 20 |
| 5 | 70.0 | 30.0 | 25 |
| 6 | 50.0 | 50.0 | 35 |
| 7 | 23.3 | 76.7 | 64 |
| 8 | 15.5 | 84.5 | 78.5 |
| 9 | 10.0 | 90.0 | 83.8 |
| 10 | 0.0 | 100.0 | 108 |

The data demonstrate that the needle penetration value can be tailored by adjusting the relative proportions of each component. More importantly, however, the data indicate that the blending effect is not linear. The surprising results shown in this table are depicted in FIG. 1 where the data is plotted as wax penetration versus the content of isomerized wax.

What is claimed is:

1. A process for producing a hydrocarbon synthesis wax composition comprising:

(a) forming raw wax in a F-T hydrocarbon synthesis process, said wax having a first needle penetration value and an opaque white color;

(b) forming an isomerized F-T wax by hydroisomerizing a raw wax formed according to step (a) at hydroisomerization conditions, said isomerized wax having a second needle penetration value, said second needle penetration value being greater than said first needle penetration value; and (c) blending at least a portion of said raw wax from step (a) with at least a portion of said isomerized wax from step (b) in such a blending ratio so as to result in a blended wax having a predetermined third needle penetration value and an opaque white color.

2. The process of claim 1 wherein said third needle penetration value is greater than said first needle penetration value and less than said second needle penetration value.

3. The process of claim 1 the hydroisomerization of step (b) is conducted under conditions such that 0–10% of hydrocarbons boiling above 371° C. are converted to hydrocarbons boiling below 371° C.

4. The process of claim 1 wherein said raw wax of step (a) boils above about 441° C. and said isomerized wax of step (b) boils above about 413° C.

5. A process for producing a hydrocarbon synthesis wax composition comprising:

(a) forming a raw wax in a Fischer-Tropsch hydrocarbon synthesis process and subsequently separating said raw wax into a raw wax fraction boiling above about 441° C. said raw wax fraction having a first needle penetration value and an opaque white color;

(b) forming an isomerized wax by passing a raw wax formed in a Fischer Tropsch hydrocarbon synthesis process according to step (a) over a hydroisomerization catalyst in a hydroisomerization process and subsequently separating said isomerized wax into an isomerized wax fraction boiling above about 413° C. said isomerized wax fraction having a second needle penetration value said second needle penetration value being greater than said first needle penetration value; and, (c) blending at least a portion of said raw wax fraction boiling above about 441° C. from step (a) with at least a portion of said isomerized wax fraction boiling above about 413° C. from step (b) in such a blending ratio so as to result in a blended wax having a predetermined third needle penetration value and an opaque white color, wherein said third needle penetration value is greater than said first needle penetration value and less than said second needle penetration value.

* * * * *